US005676451A

United States Patent [19]

Tabanera

[11] Patent Number: 5,676,451

[45] Date of Patent: Oct. 14, 1997

[54] ELECTROLUMINESCENT JACKET AND BAG

[76] Inventor: Dennis A. Tabanera, 228 Willowdale Rd., Morgantown, W. Va. 26505

[21] Appl. No.: 681,751

[22] Filed: Jul. 29, 1996

Related U.S. Application Data

[62] Division of Ser. No. 419,798, Apr. 11, 1995, Pat. No. 5,567,040.

[51] Int. Cl.[6] ..... A45C 15/06

[52] U.S. Cl. ..... 362/156; 362/84; 362/154

[58] Field of Search ..... 362/103, 105, 362/106, 108, 155, 154, 156, 84; 2/905

[56] References Cited

U.S. PATENT DOCUMENTS 5,245,517 9/1993 Fenton ..... 362/84

5,268,827 12/1993 Granneman et al. ..... 362/156

FOREIGN PATENT DOCUMENTS 4101595 7/1992 Germany ..... 362/108

*Primary Examiner*—Y. My Quach

*Attorney, Agent, or Firm*—Spencer D. Conard

[57] ABSTRACT

A jacket is provided which comprises (a) a fabric shell, (b) an electroluminescent film strip, (c) a battery and (d) an inverter. The shell comprises (i) a body section and (ii) a pair of sleeves. The body section includes (A) an internal pocket for carrying the battery and inverter, and (B) a retainer comprising a pair of retaining flaps which releasably retain the film strip. The releasable retention of the film by the flaps allows for the appearance of the film as an integral portion of the jacket and further allows for convenient separation of the film from the jacket for washing and drying of the jacket. The film may be easily repositioned under the flaps for retention by the shell. The jacket is useful for enhancing the visibility of the wearer to others at night, such as during night walking or running.

3 Claims, 7 Drawing Sheets

ELECTROLUMINESCENT JACKET AND BAG

This is a divisional application of parent application Ser. No. 08/419,798 filed Apr. 11, 1995, now U.S. Pat. No. 5,567,040.

BACKGROUND OF THE INVENTION

1. Field of the Invention

The present invention relates to jackets and bags, and more particularly relates to light emitting jackets and bags.

2. Description of the Related Art

The utilization of electroluminescent lamp devices as visual indicators to be worn by a person is known, see published European Patent Application 0166534 published Jan. 2, 1986. Such devices were secured to a carrier such as a waist coat or a helmet by stitching, welding or by an adhesive. Fixed attachment of the lamp film to carrier undesirably prevents the wearer from subjecting the carrier to periodically needed washing and heat drying because exposure of the lamp film to heat and moisture can undesirably degrade the lamp film. Additionally, it is aesthetically and functionally important that the lamp appear to be and functionally be a component of the underlying carrier.

Consequently, there is a need for a jacket (and a bag) which exhibits the safety features of electroluminescent film lamps, and which can be easily cleaned without damage to the electroluminescent lamp film.

SUMMARY OF THE INVENTION

A jacket is provided which comprises (a) a fabric shell, (b) an electroluminescent film strip, (c) a battery and (d) an inverter. The shell comprises (i) a body section and (ii) a pair of sleeves. The body section includes (A) an internal pocket for carrying the battery and inverter, and (B) a retainer comprising a pair of retaining flaps which releasably retain the film strip. The releasable retention of the film by the flaps allows for the appearance of the film as an integral portion of the jacket and further allows for convenient separation of the film from the jacket for washing and drying of the jacket. The film may be easily repositioned under the flaps for retention by the shell. A bag is also provided comprising (a) a fabric envelope, (b) an electroluminescent film strip, (c) a battery, and (d) an inverter. The envelope comprises a retainer comprising a pair of retaining flaps which releasably retain the film strip.

DETAILED DESCRIPTION OF THE INVENTION

Figure 1:
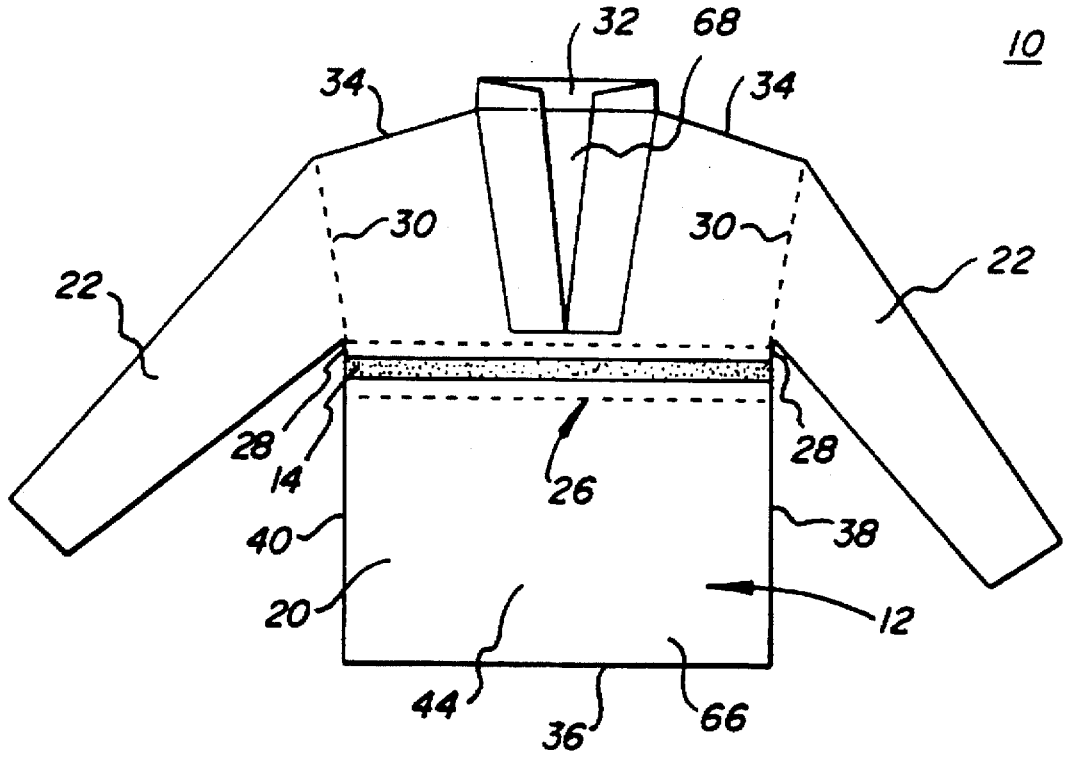
FIG. 1 is a front side elevational view of a jacket according to the present invention.

As shown in FIGS. 1, 2, 3, 4 and 9, a jacket (10) is provided comprising (a) a fabric shell (12), (b) an electroluminescent film lamp (14), (c) a battery (16), and (d) an inverter (18). The shell includes (i) a body section (20) and (ii) a pair of sleeves (22) extending from the body section (20). The body section (20) includes (A) an internal pocket (24) (which may have a protective flap (25)) and (B) a retainer (26) for releasable retaining the film (14) in a position adjacent the shell (12).

Figure 2:
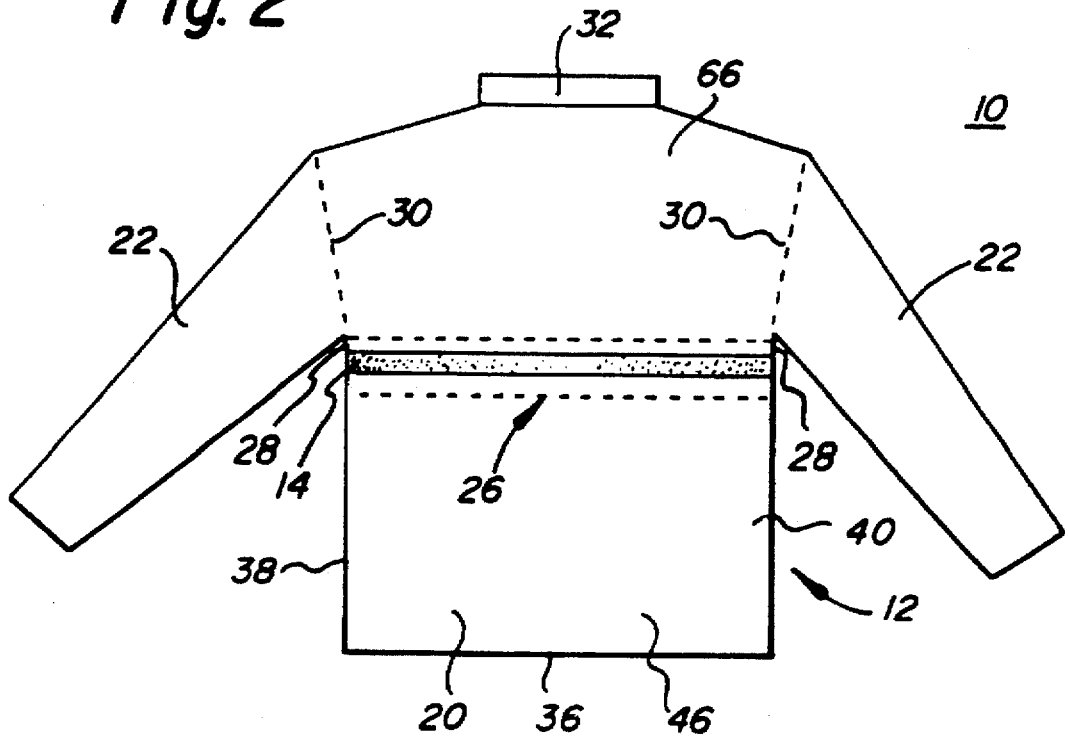
FIG. 2 is a rear side elevational view of the jacket of the present invention.

The jacket (10) may be a pull-over type as shown in FIGS. 1 and 2 or may have a zipper (not shown) in the front center of the jacket (10). The retainer (26) and film (14) preferably extend horizontally around the perimeter of the jacket (10) and are preferably located immediately below the lowest point (28) of the attachment (corresponding to the armpit) of the sleeves (22) to the body section (20). The body section (20) is attached to the sleeves (22) at arm holes (30) as is well known. The jacket further includes a collar (32). The shell (12) has a pair of shoulders (34), a bottom edge (36), a left extremity (38) and a right extremity (40) (as experienced by the wearer (not shown)). The pullover styled jacket (10) may have a v-neck extending down the front (44) of the jacket (10) from the collar (32). FIG. 2 shows the back (46) of the jacket (10).

Figure 3:
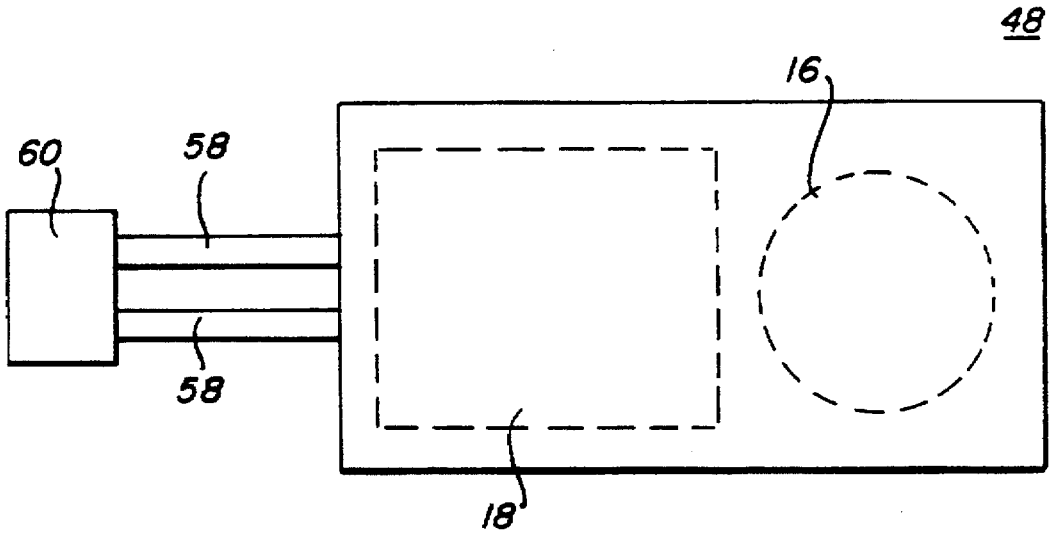
FIG. 3 is a top plan view of a power unit of the jacket.
Figure 4:
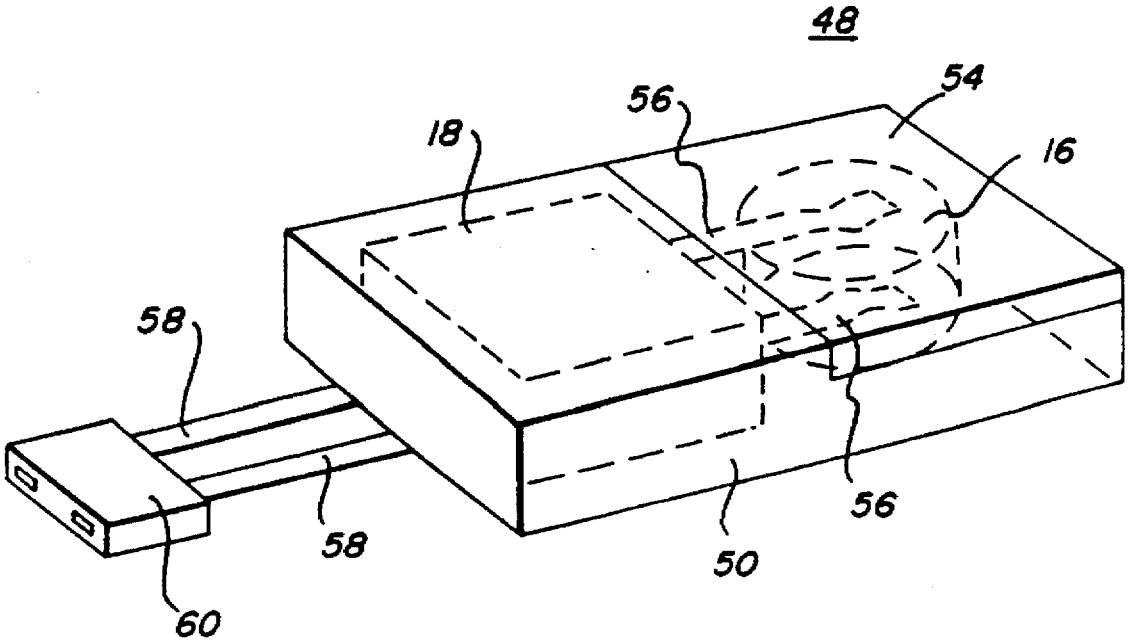
FIG. 4 is a perspective view of the power unit of FIG. 3.
Figure 9:
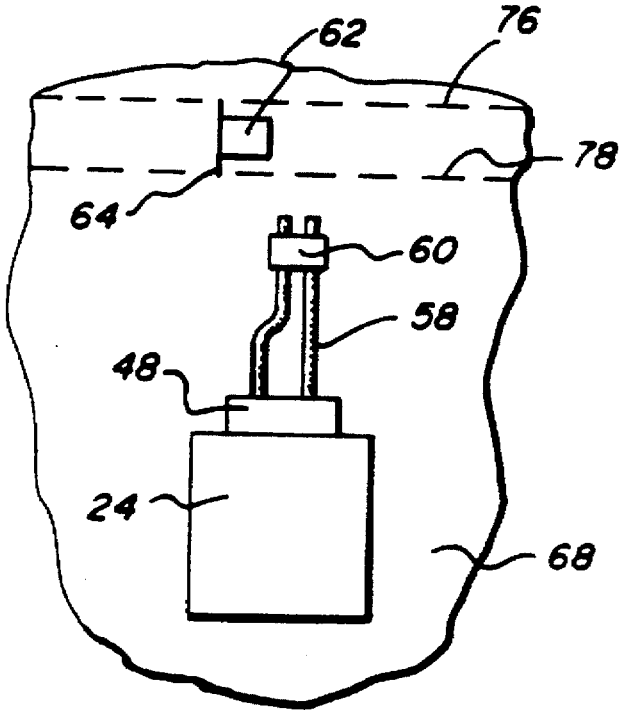
FIG. 9 is a cutaway side elevational view of an internal area of the jacket.

As shown in FIGS. 3, 4 and 9, the jacket (10) preferably has a power unit (48) which comprises a (i) housing (50), (ii) a battery (16) and (iii) an inverter (18). The housing (50) preferably comprises a thermoplastic box and a lid (54). The box (52) may contain a polymeric foam (not shown) for stable retention of the inverter (18) and battery (16). The lid (54) may be designed to snap on or slide on, and serves to provide access to the battery (16) for replacement thereof when necessary. A pair of electrical conductors (tabs) (56) provide electrical communications between the battery (16) and inverter (18). A pair of wires (58) serve as electrical conductors from the inverter (18) to the film (14) for providing electrical communication therebetween. A female connector (60) and male connector (62) may be utilized to couple the wires (58) of the power unit (48) with the film (14) for supplying alternating current from the inverter (18) of the power unit (48) to the film (14) to cause the film (14) to emit light. Alternatively, the wires (58) may be directly connected to the film (14) thereby eliminating the need for the connectors (60, 62). Access of the film (14) which is positioned on the exterior (66) of the jacket (40) to the power unit (48) which is positioned on the interior of the jacket (10) for electrical communication therebetween may be achieved through slit (64). The housing (50) is preferably of a small size to permit easy positioning within the jacket (24), and most preferably has a length of between 2 and 4 inches, a width of between 1.5 and 3 inches, and a depth of between 0.5 and 1 inches. The wires (58) are suitably insulated.

As shown in FIGS. 5, 6, 7, 8 and 9, the retainer (26) includes an upper flap (70), a lower flap (72) and a back section (74). The flap (70) is held in position by stitching (76), and the flap (72) is held in position by stitching (78). The upper flap (70) extends downwardly and has a downward most horizontal edge (80), and the lower flap (72) extends upwardly and has an upward most horizontal edge (82). When the flaps (70, 72) are within closed positions with the edges (80, 82) adjacent the back section (74) and film (14), the spacing between the edges (80, 82) is less than the width of the film (14), and preferably is between 0.25 and 0.75 inches. The film (14) preferably has a width of between 0.50 and 1.50 inches and has a length of between 20 inches and 50 inches depending on the size of the jacket (10). The width of the back section (74) is greater than that of the film (14), and is preferably between 1.0 and 2.0 inches from (i) an upper crease (84) where upper flap (70) is foldably connected to back section (74) at the upper end thereof to (ii) a lower crease (86) where lower flap (72) is foldably connected to back section (74) at the lower end thereof. The stitchings (76, 78) are located adjacent the creases (84, 86) respectively to avoid interference with the retainer's retention of the film (14). Each flap (70, 72) preferably has a width of between 0.25 inches and 0.75 inches as measured from the creases (84, 86) to the flap edges (80, 82) respectively. The pocket (24) preferably has a width of between 3 and 6 inches and a depth of between 4 and 6 inches, wherein the width of the pocket (24) is greater than the width of the power unit (48). The length of the power unit (48) may be greater than, equal to or less than the depth of the pocket (24).

The flaps (70, 72) overlap respective outer portions (88, 90) of the film (14) thereby retaining the film (14) between the flaps (70, 72) and the back section (74). The gap between the flap (70) and flap (72) effectively exposes a light emitting central strip zone (92) for view by others. The central zone being located between the spaced apart outer portions (88, 90) and integral therewith.

In operation, the power unit (48) is located in the pocket (24) and the film (14) is held in the retainer (26). The power unit (48) supplies power to the film (14) and causes the film (14) to emit light which can then be reviewed by passersby. In more detail, the battery (16) supplies direct current to the inverter (18) which converts the direct current to alternating current. The inverter (18) supplies the alternating current to the film (14) thereby causing the film (14) to emit light.

In order to wash and heat dry the jacket (10), the wearer simply needs to remove the power unit (48) and film (14) from the jacket (10). The power unit is easily removed from the jacket (10), and the film (14) easily pulls loose from retainer (26), and the shell (12) may then be subjected to water and heat in the washing and drying processes. After washing and drying the shell (12), the power unit may be returned to the pocket (24) and the film (14) may be easily reinserted under the flaps (70, 72). The slit (64) allows for insertion of the film (14) therein for connection to the power unit (48). The flaps (70, 72) may be bent away from the back section (74), but are biased to a position adjacent the back sections (74) and substantially parallel therewith.

The battery (16) is preferably a 3 to 12 volt battery which provides direct current. The inverter (18) preferably converts the direct current to alternating current having a voltage of between 110 volts and 600 volts and a frequency of 200 Hertz to 2000 Hertz. An electrical power cut-off device may be used to prevent the alternating current voltage from short circuiting. The power unit may be supplied with an on/off switch (not shown) to control delivery of power to the film (14).

The electroluminescent film lamp (14) is flexible and preferably has a rear aluminum foil electrode preferably 0.002 inches thick, a dielectric resin layer preferably 0.001 inches thick, a phosphor resin layer preferably 0.001 inches thick and a transparent film layer preferably 0.002 inches thick. The film (14) preferably includes a plastic envelope which discloses the layers and protects them from moisture.

Figure 10:
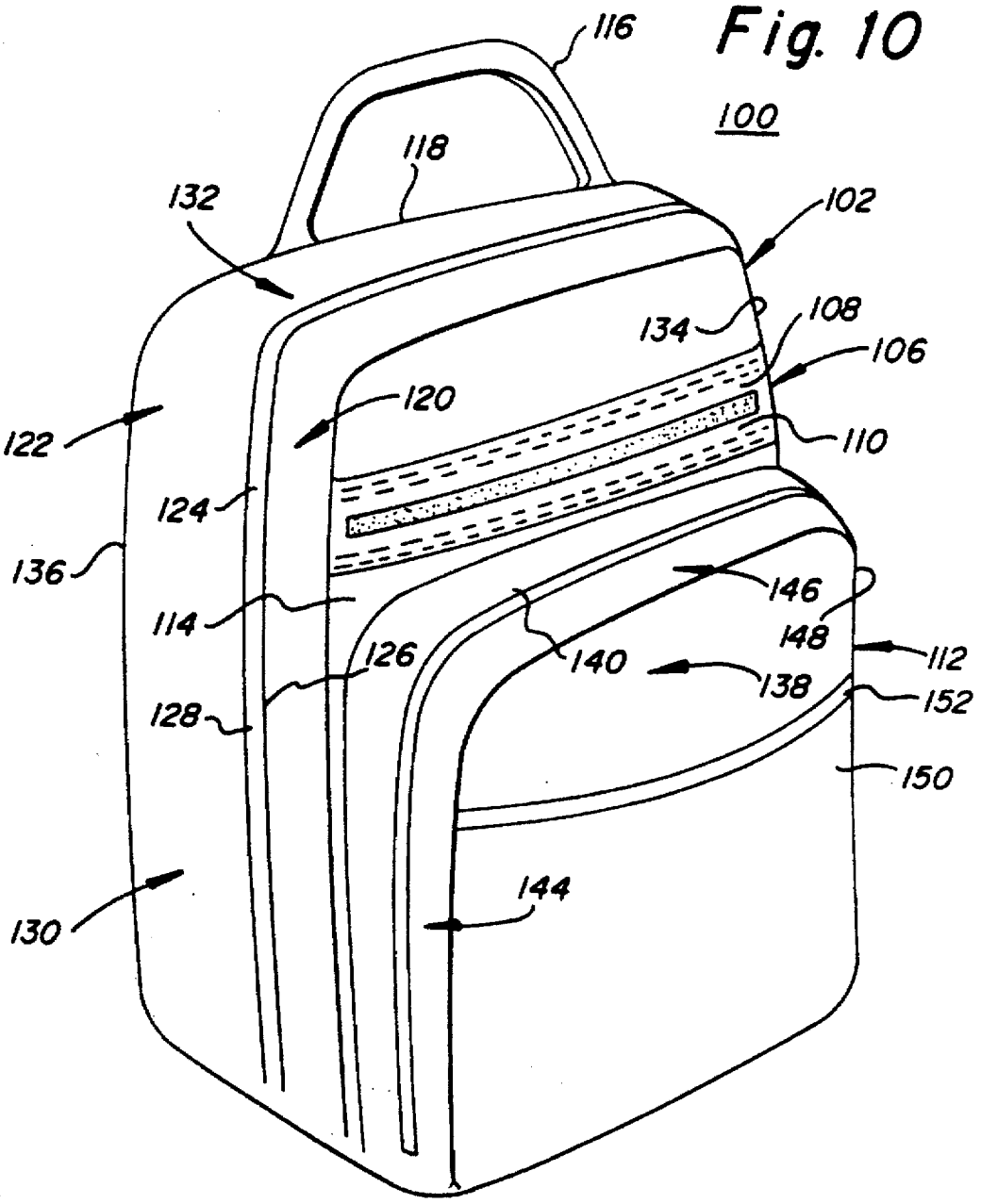
FIG. 10 is a perspective view of a bag according to the present invention.
Figure 11:
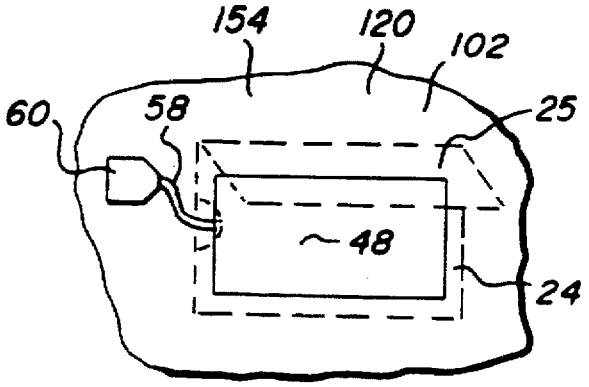
FIG. 11 is a cutaway side elevational view of an internal arc of the pocket of the bag shown in FIG. 10.

As shown in FIGS. 10 and 11, a bag (100) is provided comprising (a) a fabric envelope (102), (b) an electroluminescent film strip (104), (c) a battery (16) and (d) an inverter (18). The envelope (102) comprises a retainer (106) comprising a pair of retaining flaps (108, 110) which releasable retain the film strip (104). The bag (100) preferably comprises a secondary pouch (112) attached to the front (114) of the envelope (102) wherein the pouch (112) is smaller in volume carrying capacity then the envelope (102). The bag (100) preferably also comprises a handle (116) attached to an upper portion (118) of the bag (100). The envelope (102) has two halves (120, 122) which are selectively interconnected by a zipper (124) which can be operated for total enclosure of the envelope (102) (and total interconnection of the edges (126, 128) of the two halves (120, 122)) or can be opened for access to the interior of the envelope (102). The zipper (124) is preferably in an inverted u-shape running up one vertical side (130) of the envelope (102), across the top (132) of the envelope and down the other side (134) of the envelope. The envelope (102) has a front (114) and a back (136) which are spaced apart and which are connected together by the sides (130, 134 and top 132) when the zipper (124) is closed. The pouch (112) is preferably attached to the front (114) of the envelope (102) and is positioned beneath the horizontal retainer (106). The position of the retainer (106) on an upper section of front (114) of the envelope (102) positions the film for maximum visibility. The pouch (112) preferably has a front half (138) and a back half (140) which are interconnected (at least partially) by an upside down u-shaped zipper which runs up on side (144) of the pouch (112), across the top (146) of the pouch (112) and down the other side (148) of the pouch (112). The pouch (112) may further contain a frontal subpouch (150) which may be zipped open or shut with a horizontal linear zipper (152).

As shown in FIG. 11, the front half (120) of the envelope (102), in the interior (154) of the envelope (102), has a pocket (158) which carries a battery (16) and an inverter (18), preferably in the form of a power unit (48). The power unit (48) is shown in more detail in FIGS. 3 and 4. The pocket preferably has an upper cover for receiving and removing the power unit (48) therefrom, and preferably has a small side opening for receiving and removing the wires (58) and the connector (60).

Figure 8:
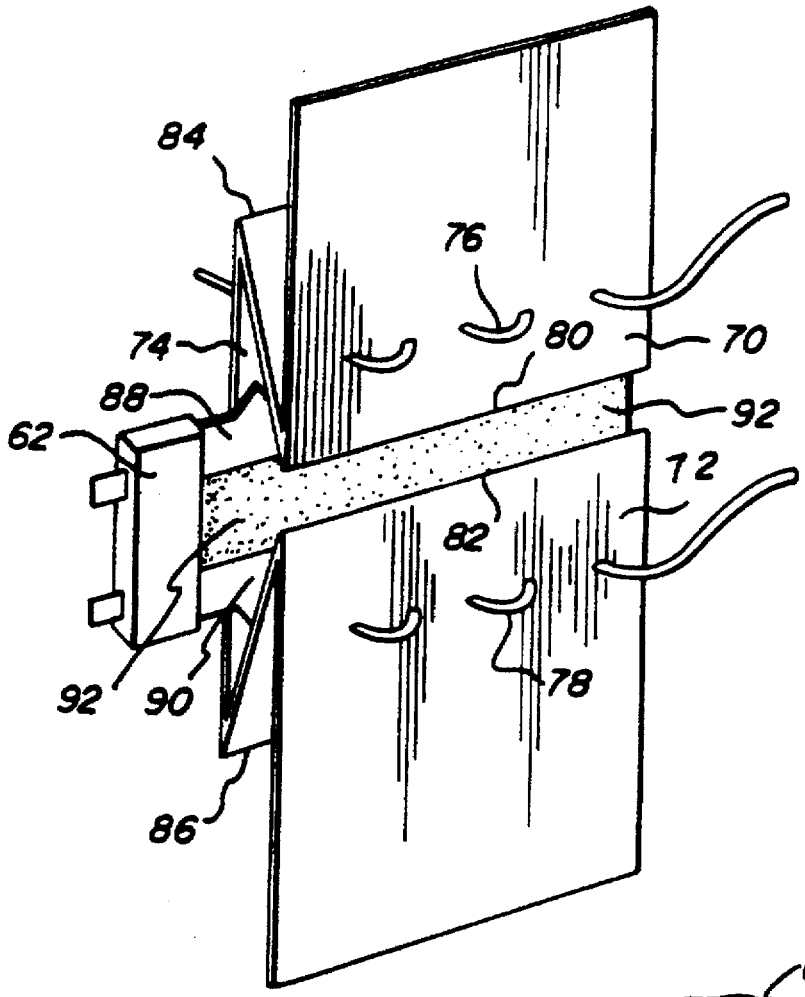
FIG. 8 is an exploded cutaway perspective view of an alternative embodiment of the retainer.
Figure 13:
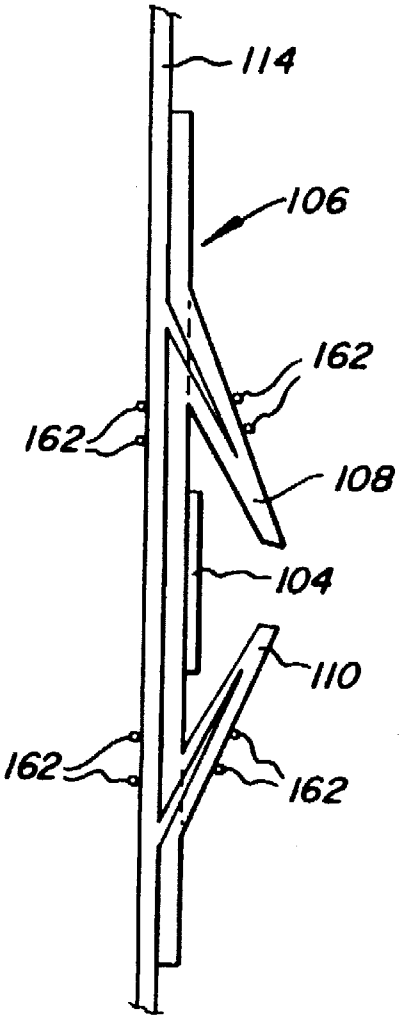
FIG. 13 is a side elevational vertical cross-sectional cutaway view of the retainer of the bag of FIG. 10.
Figure 12:
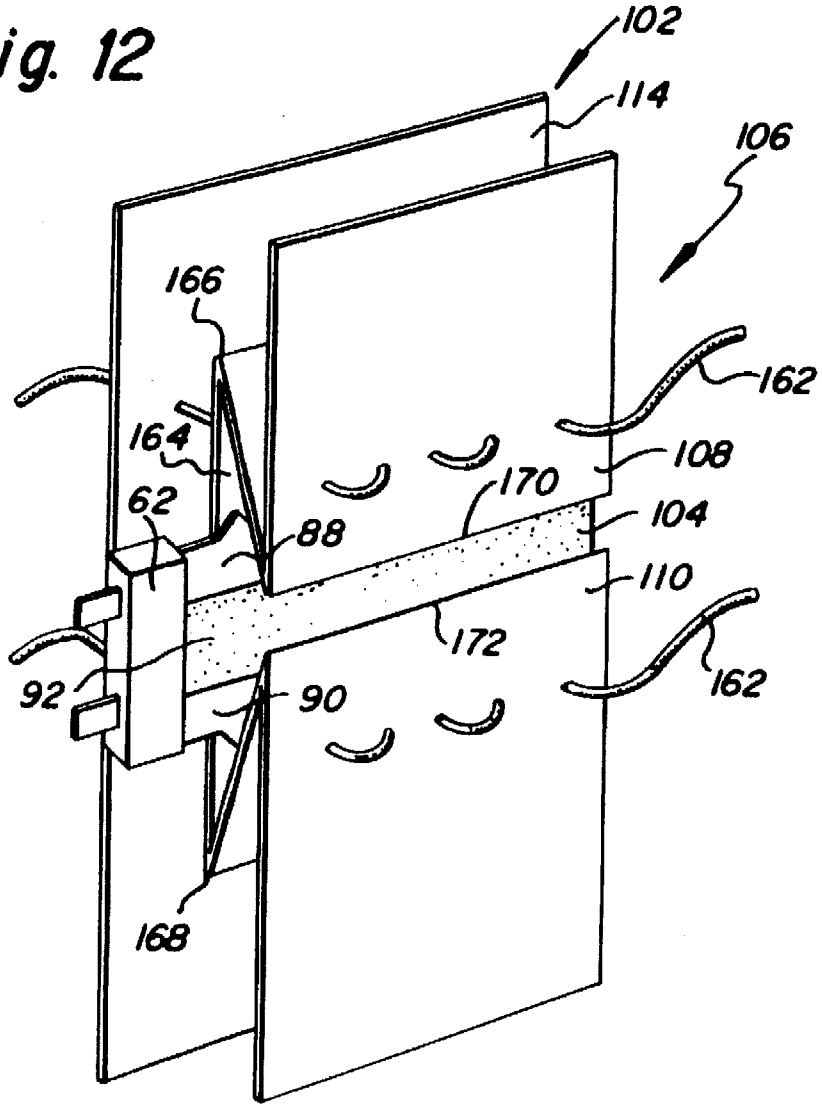
FIG. 12 is an exploded perspective cutaway view of the retainer of the bag of FIG. 10.
Figure 14:
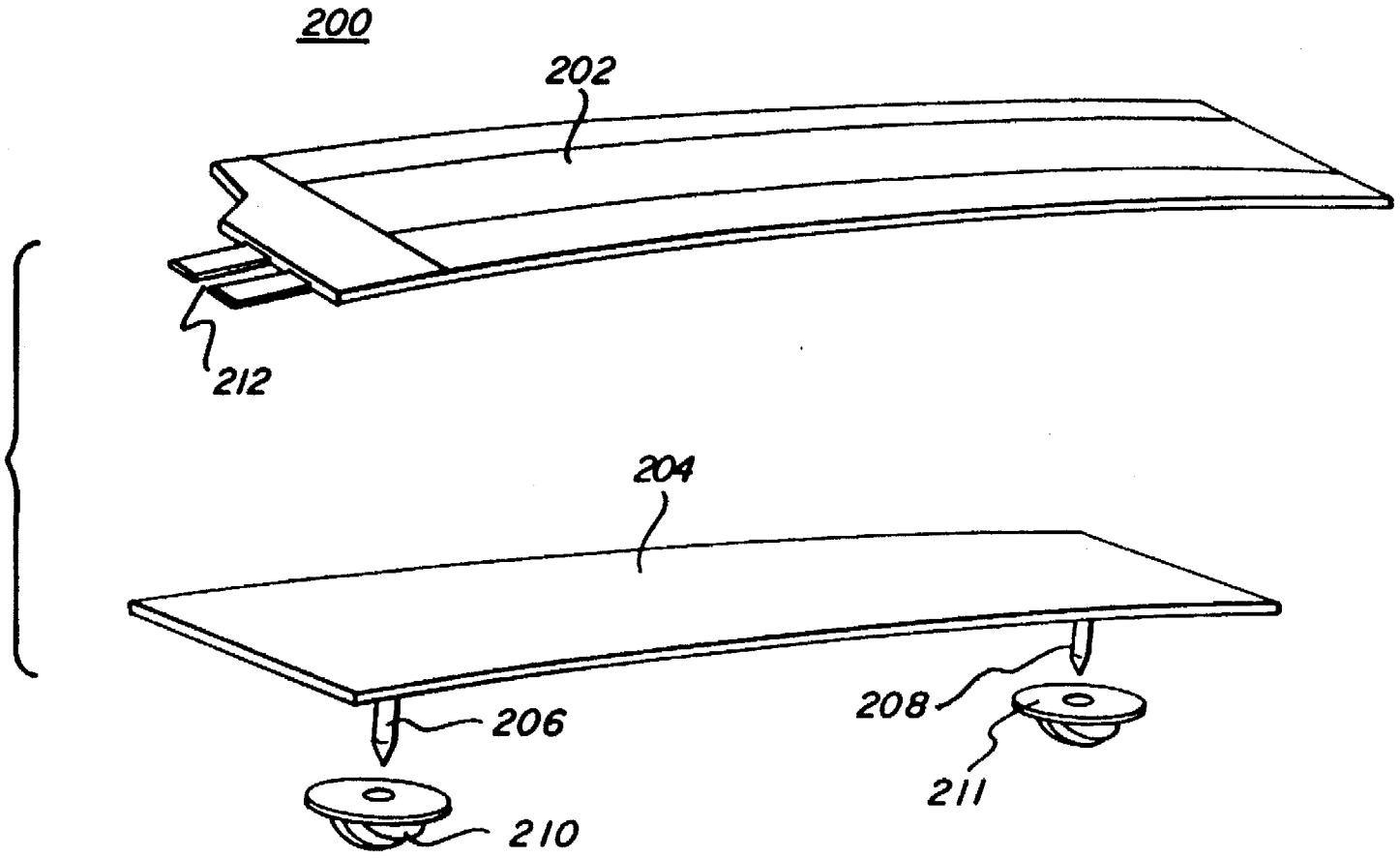
FIG. 14 is an exploded view of a light strip having pins.

The retainer (106) of the bag (100) may be made as shown in FIG. 8 or as shown in FIGS. 10, 11, 12 and 13. The retainer (106) may be a separate piece of fabric single (or double as shown in FIG. 13) stitched (as shown in FIG. 12) to the front side (114) of the envelope (102) by stitches (162). The retainer (106) is similar in description to that of FIG. 8 except that a separate piece of fabric was utilized for the retainer (106) in FIG. 12. The film (104) like film (14) has a connector (62), outer portions (88, 90) and central strip zone (92). The flaps (108, 110) overlap respective outer portions (88, 90). The retainer has a back section (164).

The width of the back section (164) is greater than that of the film (104), and is preferably between 1.0 and 2.0 inches from (i) an upper crease (166) where upper flap (108) is foldably connected to back section (164) at the upper end thereof to (ii) a lower crease (168) where lower flap (110) is foldably connected to back section (164) at the lower end thereof. The stitchings (162) are located adjacent the creases (166, 168) respectively to avoid interference with the retainer's (106) retention of the film (104). Each flap (108, 110) preferably has a width of between 0.25 inches and 0.75 inches as measured from the creases (166, 168) to the flap edges (170, 172) respectively.

The bag (100) may be in the form of a back pack, a tote bag, a sports bag, a book bag or other suitable fabric bags which are carried in the evening hours. Smaller light strips (200) may also be used wherein a film (202) is adhered to a backing (204) which may be in the form of either rigid or flexible, but is preferably a rigid flat rectangular plastic substrate having a pair of spaced apart pins (206, 208) depending from the backing on the side opposite the side that is adhered to the film (202). The pins have pointed ends for extending through the fabric of the jacket or bag, and are releasably received by clip type fasteners (210, 211) respectively which retain the backing (204) against the fabric. The film (202) has a pair of male type connectors (212) for electrical communication with a power unit as set out above.

Figure 6:
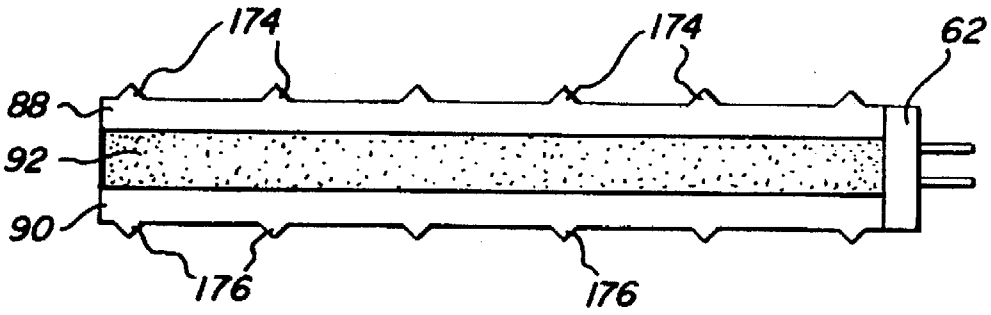
FIG. 6 is a side elevational view of the electroluminescent film lamps of FIG. 5.
Figure 7:
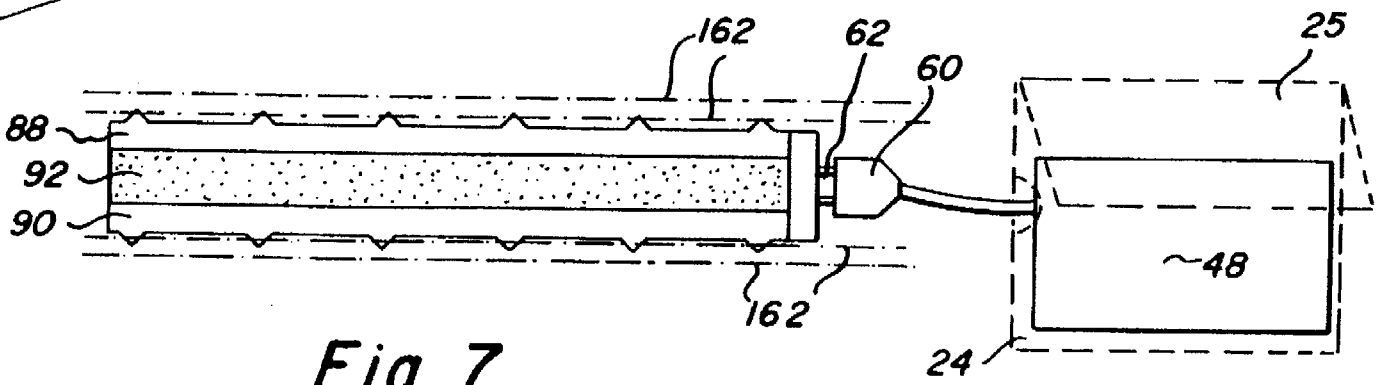
FIG. 7 is a side elevational view of the retainer with the flaps removed, and-shows the power unit in the pocket with the pocket cutaway.
Figure 5:
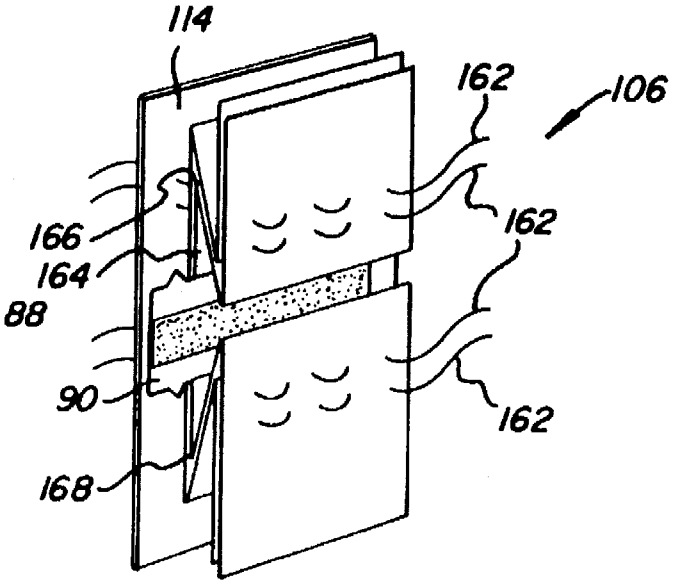
FIG. 5 is an exploded cutaway perspective view of the retainer of the jacket of FIG. 1.

The film (14) as best shown in FIG. 6, preferably has a series of outwardly extending projections (174, 176) which extend from outer portions (88, 90) respectively. The projections are preferably triangular in shape for resisting unintentional sliding motion within the retainer (26). The projections on a given outer portion (88, 90) are preferably equally (horizontally) spaced apart, and most preferably are spaced apart between 0.5 and 1.0 inches from the next closest projection. Preferably, the projections on opposing outer portions (88, 90) are immediately opposite each other to provide a point to point width sufficient to simultaneously engage the stitchings (76, 78) thereby resisting unintentional slippage of the film (14) within the retainer, as best shown in FIG. 7. FIG. 5 shows an exploded view of the retainer and film.

I claim:

1. A bag comprising:

(a) a fabric envelope having an exterior, (b) a power unit held by said envelope, (c) an electroluminescent film lamp releasably retained by said envelope on the exterior of said envelope, said envelope comprising a retainer which comprises an upper flap, a lower flap spaced apart from said upper flap and extending toward said upper flap, and a back section connected to and overlayed by said flaps, said film lamp being retained between said flaps and said back section, said flaps being spaced apart thereby exposing a central portion of said film lamp, said power unit being in electrical communication with said film lamp for supplying power thereto.

2. The bag of claim 1 wherein said bag comprises a pouch attached to said envelope.

3. The bag of claim 1 wherein said film lamp is linear.

* * * * *